United States Patent [19]

Smith

[11] 4,203,086

[45] May 13, 1980

[54] TEMPERATURE-SENSITIVE SPIRAL SPRING SLIDING CONTACT DEVICE

[75] Inventor: Dennis D. Smith, Carol Stream, Ill.

[73] Assignee: Illinois Tool Works Inc., Chicago, Ill.

[21] Appl. No.: 947,674

[22] Filed: Oct. 2, 1978

[51] Int. Cl.[2] ..... H01H 37/76

[52] U.S. Cl. ..... 337/410; 337/407

[58] Field of Search ..... 337/410, 407, 149, 238, 337/239, 401, 403

[56] References Cited

U.S. PATENT DOCUMENTS 3,995,246 11/1976 Morgan ..... 337/407

*Primary Examiner*—Harold Broome

*Attorney, Agent, or Firm*—Glenn W. Bowen; Robert W. Beart

[57] ABSTRACT

A temperature-sensitive switching device is provided in a casing having a pair of leads that extend therefrom, by a spiral spring which forms a first electrical contact and a curved conducting member which forms a second electrical contact. The spiral spring is connected to one of the leads and is expanded and fitted over a thermally-fusible pellet which melts at a predetermined temperature. The outer diameter of the pellet is larger than the inner diameter of the spiral spring contact before it is expanded. The end of the spiral spring contact contains a curved connecting projection, which preferably forms a circular arc, that serves as a sliding contact. The other contact element is provided by a matching fixed curved conducting projection which is connected to the other lead. When the thermally-fusible pellet melts, the tension in the spring is released and it relaxes to its unexpanded size causing the conducting projection on the end of the spring to spiral either into, or out of, contact with the conducting projection on the fixed position lead thereby making, or breaking, the circuit.

9 Claims, 3 Drawing Figures

TEMPERATURE-SENSITIVE SPIRAL SPRING SLIDING CONTACT DEVICE

BACKGROUND OF THE INVENTION

Thermal cut-off devices are known which employ coil springs to achieve the necessary switching action in a thermal switching device when a thermally-fusible pellet melts. The use of separate springs and electrical contacts increases the component cost and the relative size and complexity of such a switching device. In the present invention, the required spring action and the necessary electrical contact between the leads are provided by a spiral spring which has an unexpanded inner diameter that is less than the outer diameter of a thermally-fusible pellet. The spring is expanded and fitted over the pellet and is held thereby so that a curved conducting projection at the end of the spiral spring is in contact with a mating curved conducting portion that is secured to the other lead. A thermally-sensitive switching device is thereby provided which has a reduced component court, is very small in size, is relatively inexpensive, and may carry a high current and may be assembled as either a normally open or a normally closed device.

DESCRIPTION OF THE DRAWINGS

The present invention is illustrated by reference to the drawings in which.

TECHNICAL DESCRIPTION OF THE INVENTION

Figure 1:
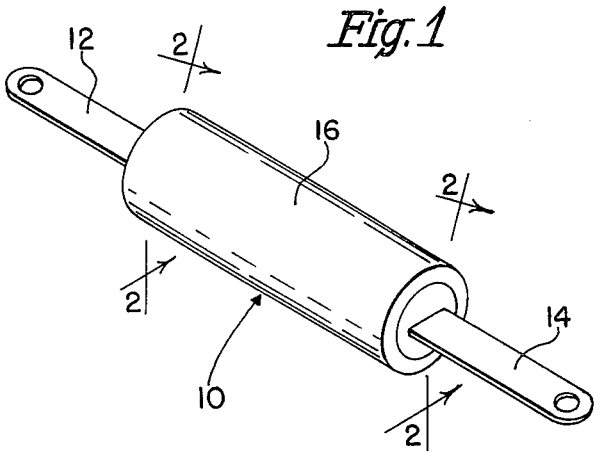
FIG. 1 represents a perspective view of the thermal switching device of the present invention.

The thermal switching device of the present invention is shown in FIG. 1 as having a pair of flat leads 12, 14 which extend from opposite sides of a case 16, which is preferably formed of an insulating material such as ceramic. The ceramic case 16 is sealed at opposite ends by means of a suitable sealing material such as epoxy. Sauersin Cement No. 63, which is made by Sauersin Cements Company, or other suitable types of sealing material may be used. The portion of the lead 14 which extends into the case 16 has an integrally formed conductive curved projection 23 at its inner end which is supported by the cylindrical section 22. The projection 23 is preferably formed in the shape of a circular arc. A spiral electrically conductive spring 24, which has an unexpanded normal inner diameter which is less than the outer diameter of a thermally-sensitive pellet 26, is expanded and placed over the pellet 26 to be held in a stressed condition thereof. The pellet 26 may be made of a number of thermally-fusible materials, which are well known to those skilled in the art.

Figure 2:
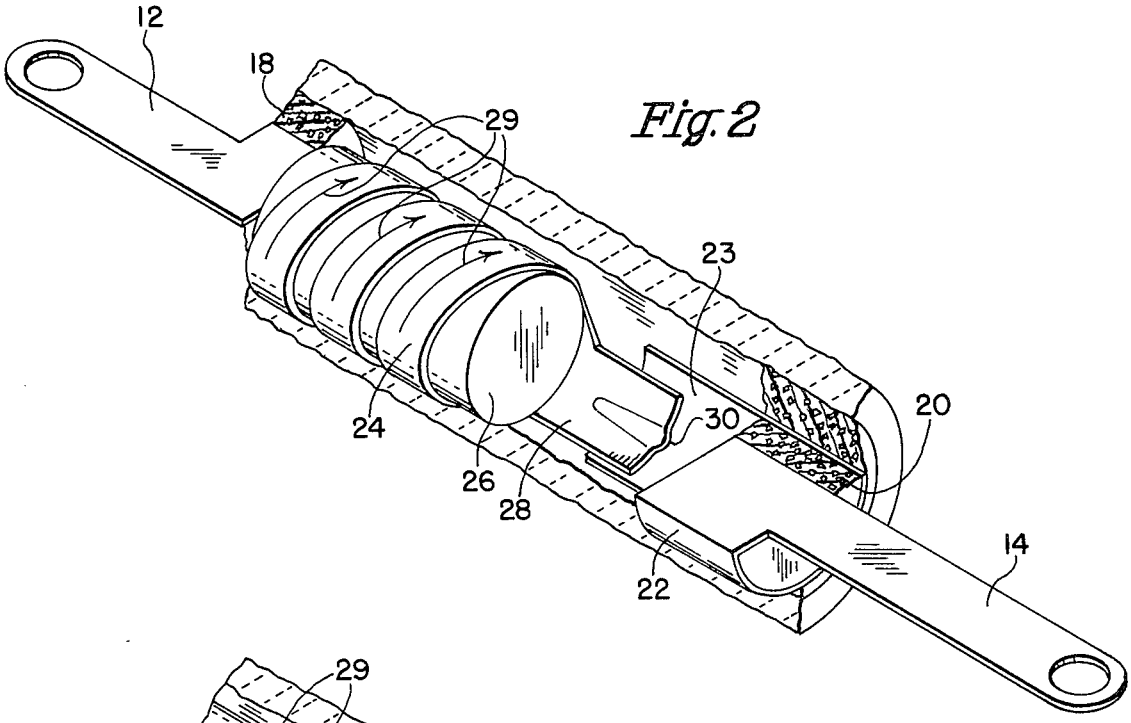
FIG. 2 is a cross-sectional view of the thermal switching device of FIG. 1 taken along the lines 2—2 of FIG. 1, implemented as a normally closed switch.
Figure 3:
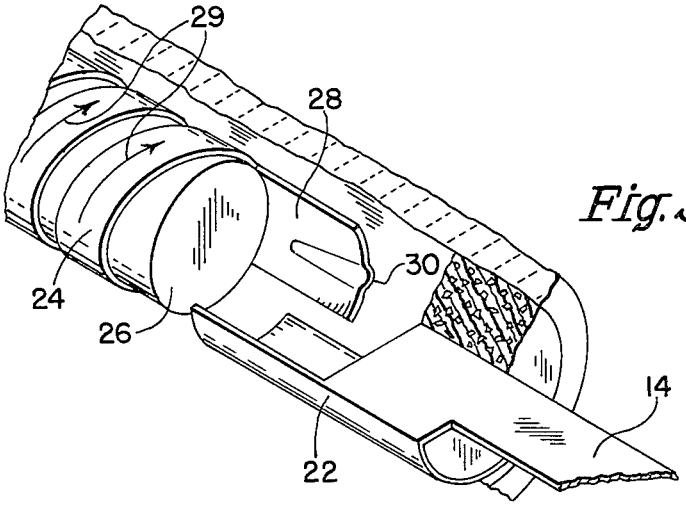
FIG. 3 is a partial cross-sectional view in accordance with FIG. 2 of a normally open version of the switch in accordance with the present invention.

The spring member 24 also has an integrally formed curved conducting projection 28 as its inner end. When the spring is allowed to relax over the outer diameter of the pellet 26, the contact projection 28 contacts the projection 23, or it may be positioned out of contact with the projection 23, in FIG. 3. FIG. 2 represents the normally closed version of the switch while FIG. 3 represents the normally open version. The only difference between the switches of FIGS. 2 and 3 being the initial position of the projection 28 relative to the projection 23. In the switch of FIG. 3, the projections 28, 22 are initially not in contact, but when the pellet 26 melts, the spiral spring will be relieved of its preset strain and will cause the projection 28 to rotate in the direction of the arrow 29 with contact with the projection 23 to form a normally open switch that is closed upon the sensing of a predetermined temperature. The contact projection 28 preferably has a dimple 30 on it which allows only this dimple to ride on the inner surface of the projection 23, so as to reduce the friction between the projection 28 and the projection 23. The projection 23, may have a corresponding dimple (not shown) if desired so that the two dimples will be initially locked together and thereby a minimum force necessary to unlock the two projections 28 and 23 will be required to activate the device.

The sliding contact design provided by the dimple 30 allows for thermal expansion of the spring 24 preventing random, or noisy, contact conditions in the normally closed device of FIG. 2. In a normally open device, the dimple 30 provides for contact wiping action. In both structures, the contact design permits relatively large tolerance variations in contact alignment during manufacture. Although the present invention is described by reference to the projection 28 being inserted within the projection 23, it also will be apparent to those skilled in the art that other versions within the scope of the present invention may be implemented with the projection 28 being located to contact the outer, rather than the inner, surface of the curved projection 23.

In operation, when the melting temperature of the thermally-fusible pellet 26 is reached it will melt, and then will flow in the casing 16 which must have cavities sufficient to receive the melted thermally-sensitive material. When this occurs, the spiral spring 24 relaxes its tension and decreases its size so that the contact projection 28 will spiral, in the direction of the arrow 29, either out of contact with the projection 23, for the normally closed switch of FIG. 2, or into contact with the projection 23, for the normally open switch of FIG. 3.

The thermally-sensitive switch of the present invention that has been described is cost effective, has an insulated housing, is capable of high current capacity and is versatile in that it may be assembled as either an open or a closed device. In addition, the overlapped condition of the spring contact and the thermally-fusible pellet allows for the construction of a very small device.

What is claimed is:

1. A thermally-sensitive switch comprising an elongated cylindrical housing, first and second leads extending from opposite ends of said housing, a first electrically-conductive projection connected to said first lead, an elongated cylindrical thermally-fusible pellet in said cylindrical housing, an elongated, spiral, electrically-conductive spring in electrical contact with said second lead, and having a plurality of turns which completely encircle said pellet in a spiral path that extends in a direction from said second lead toward said first lead, said spiral spring having a normal inner diameter which is less than the outer diameter of said thermally-fusible pellet, said spiral spring being expanded and held in a stressed expanded diameter state on said thermally-fusible pellet so that a second electrically-conductive projection connected to said spiral spring extends toward said first projection such that when said thermally-fusible pellet melts said spiral spring relaxes to its normal unexpanded diameter and the contact state between said first and said second projections is changed due to rotation of said first projection relative to said second projection.

2. A thermally-sensitive switch as claimed in claim 1, wherein said first and second projections are formed as a portion of a circular arc and said first projection is inserted inside of said second projection.

3. A thermally-sensitive switch as claimed in claim 2, wherein said first projection has a dimple thereon which contacts the inner surface of said second projection.

4. A thermally-sensitive switch as claimed in claim 1, wherein said switch is a normally closed switch and said first and second projections are in contact before said thermally-fusible pellet is melted.

5. A thermally-sensitive switch as claimed in claim 4, wherein said first and second projections are formed as a portion of a circular arc and said first projection is inserted inside of said seccond projections.

6. A thermally-sensitive switch as claimed in claim 5, wherein said first projection has a dimple thereon which contacts the inner surface of said second projection.

7. A thermally-sensitive switch as claimed in claim 1, wherein said switch is a normally open switch and said first and second projections are out of contact before said thermally-fusible pellet is melted.

8. A thermally-sensitive switch as claimed in claim 7, wherein said first and second projections are formed as a portion of a circular arc and said first projection is inserted inside of said second projection.

9. A thermally-sensitive switch as claimed in claim 8, wherein said first projection has a dimple thereon which contacts the inner surface of said second projection.

* * * * *